US009745934B2

(12) United States Patent
Hauvespre et al.

(10) Patent No.: US 9,745,934 B2
(45) Date of Patent: Aug. 29, 2017

(54) MECHANICAL SYSTEM FORMING A CAM FOLLOWER OR A ROCKER ARM

(71) Applicants: Benoît Hauvespre, Saint Etienne de Chigny (FR); Samuel Viault, Saint-Antoine-du-Rocher (FR)

(72) Inventors: Benoît Hauvespre, Saint Etienne de Chigny (FR); Samuel Viault, Saint-Antoine-du-Rocher (FR)

(73) Assignee: AKTIEBOLAGET SKF, Gothenburg (SE)

( * ) Notice: Subject to any disclaimer, the term of this patent is extended or adjusted under 35 U.S.C. 154(b) by 34 days.

(21) Appl. No.: 14/932,309

(22) Filed: Nov. 4, 2015

(65) Prior Publication Data

US 2016/0138541 A1 May 19, 2016

(30) Foreign Application Priority Data

Nov. 13, 2014 (EP) ..... 14193090

(51) Int. Cl.

| | |
|---|---|
| ***F01L 1/18*** | (2006.01) |
| ***F02M 59/10*** | (2006.01) |
| ***F01L 1/14*** | (2006.01) |
| ***F04B 1/04*** | (2006.01) |

(52) U.S. Cl.

CPC ..... *F02M 59/102* (2013.01); *F01L 1/14* (2013.01); *F01L 1/18* (2013.01); *F04B 1/0408* (2013.01); *F04B 1/0421* (2013.01); *F04B 1/0426* (2013.01); *F01L 2105/00* (2013.01)

(58) Field of Classification Search

CPC .. F02M 59/102; F01L 1/18; F01L 1/14; F04B 1/0426; F04B 1/0408; F04B 1/0421

See application file for complete search history.

(56) References Cited

U.S. PATENT DOCUMENTS

| | | | | |
|---|---|---|---|---|
| 1,802,330 A * | 4/1931 | Boland | ..... | F01L 1/14 123/90.5 |
| 4,173,954 A | 11/1979 | Speckhart | | |
| 7,793,583 B2 * | 9/2010 | Radinger | ..... | F01L 1/143 74/569 |
| 2013/0213181 A1 | 8/2013 | Dorn et al. | | |

FOREIGN PATENT DOCUMENTS

| | | |
|---|---|---|
| DE | 102013202129 A1 | 8/2014 |
| EP | 2607636 A1 | 6/2013 |
| WO | 2010/026463 A1 | 3/2010 |

* cited by examiner

*Primary Examiner* — Zelalem Eshete
(74) *Attorney, Agent, or Firm* — Bryan Peckjian; SKF USA Inc. Patent Dept.

(57) ABSTRACT

A mechanical system that forms one of a cam follower or a rocker arm. The mechanical system comprises a support element including a first body portion and a second body portion, a pin extending between two opposite ends along a first axis and supported by the first body portion of the support element, and a roller mounted on pin, movable in rotation relative to the pin around the first axis and adapted to roll on a cam. The mechanical system further comprises a spacing element comprising a first body portion connected to the second body part of the support element and a second body portion adapted to be supported by a movable support.

14 Claims, 4 Drawing Sheets

MECHANICAL SYSTEM FORMING A CAM FOLLOWER OR A ROCKER ARM

CROSS REFERENCE TO RELATED APPLICATION

This is a Non-Provisional Patent Application, filed under the Paris Convention, claiming the benefit of Europe (EP) Patent Application Number 14193090.9, filed on 13 Nov. 2014 (13.11.2014), which is incorporated herein by reference in its entirety.

TECHNICAL FIELD OF THE INVENTION

The invention concerns a mechanical system, forming a cam follower or a rocker arm, and comprising a pin and a roller. The invention also concerns an injection pump or a valve actuator comprising such a mechanical system.

BACKGROUND OF THE INVENTION

Classically, a cam follower comprises at least a tappet, a pin and a roller. The tappet extends along a longitudinal axis, while the pin and the roller are centered on a transverse axis. The tappet is formed with two lateral flanges, delimiting an intermediate gap between them and each comprising a cylindrical bore. The roller is positioned in the intermediate gap, between both flanges and bores. The pin is fitted in the two bores, such that the roller is movable in rotation relative to the pin around its axis. The pin may be caulked, in other words plastically deformed, on both opposite ends to create a mechanical connection by press-fit in the tappet bores.

When the cam follower is in service, the roller collaborates with a cam synchronized with the internal combustion engine camshaft for example. It also could be synchronized with a crankshaft, a balancing shaft or any other dedicated shaft. The rotation of the camshaft leads to a periodic displacement of a piston of the pump that rests against the tappet, to allow fuel to be delivered. The tappet is movable back and forth along the longitudinal axis in a bore belonging to the injection pump, with the cylindrical outer surface of the tappet sliding in this bore. The roller is movable in rotation around its central axis. The tappet is axially actuated by a movable element, for example a plunger or a shaft.

As shown by example in EP-A-2 607 636, it is known to provide the tappet with two flanges having holes for supporting the ends of the pin on which the roller is mounted. The holes in the flanges each have a radial recess adapted to receive a plastically deformed radial portion of the caulked end of the pin. For assembling the cam follower, the roller is mounted between the flanges of the tappet. Then, the pin is inserted in the roller, through the holes of the flanges, the ends of the pin being supported by the flanges. Then, the ends of the pin are caulked.

Cam followers are generally used in valve actuators and injection pumps for motor vehicles and are delivered as pre-assembled units to a motor vehicle manufacturer. Different applications and different manufacturers imply different geometries, in particular different cam follower dimensions. It is known to design a forged tappet with adapted given dimensions for each application. However, it is not an efficient manufacturing method and forged parts are expensive.

SUMMARY OF THE INVENTION

The aim of the invention is to provide an improved mechanical system with an adaptive and cost-saving design enabling an assembly with the maximum of standard parts useable for different applications for the sake of cost reduction.

To this end, the invention concerns a mechanical system forming a cam follower or a rocker arm, the mechanical system comprising a support element comprising a first body part and a second body part, a pin extending between two opposite ends along a first axis and supported by the first body part of the support element, and a roller mounted on the pin, movable in rotation relative to the pin around the first axis and adapted to roll on a cam.

According to the invention, the mechanical system further comprises a spacing element comprising a first body portion connected to the second body part of the support element and a second body portion adapted to be supported by a movable support.

Thanks to the invention, the mechanical system elements can have a standardized design and the only part to be adapted and specific for each application is the spacing element. It allows a standardization production of the maximum number of elements and then reduces the manufacturing costs.

According to further aspects of the invention which are advantageous but not compulsory, such a mechanical system may incorporate one or several of the following features:

- The first body part of the support element comprises two support flanges provided with bores receiving the ends of pin.
- The second body part of the support element comprises a cavity wherein the first body portion of the spacing element is inserted and connected.
- Spacing element is press-fitted within the cavity of the support element.
- Spacing element is glued, welded or attached by any other appropriate means to the support element, for example by pins or retaining ring.
- The first body portion of the spacing elements comprises at least two lateral flanges that perpendicularly extend from the second body portion of the spacing element.
- Spacing element comprises an even number of lateral flanges, each pair of lateral flanges being diametrically positioned and facing each other.
- Outer surfaces of the lateral flanges at least partly contact inner lateral cylindrical surface of the cavity of the support element.
- The first body portion of the spacing element comprises a tube provided with a peripheral annular wall and openings at each end so as to define a cylinder hollow shape.
- Outer cylindrical lateral surface of the tube contacts inner lateral cylindrical surface of the cavity of the support element.
- The second body portion of the spacing element comprises a base support provided at an end of the first body portion of the spacing element at the opposite side of the support element, the base support defining a surface adapted to be supported by a movable element.
- The base support is a plate.
- The second body portion of the spacing element comprises a base support and further comprises an edge axially extending from the base support.
- The first and second body portions of the spacing element are two distinct elements assembled and attached together.
- The first and second body portions of the spacing element are welded, glued, press-fitted or attached by any other appropriate means, for example by pins or retaining ring.

An outer cylindrical lateral surface of the tube is slightly higher than an inner cylindrical lateral surface of the edge of the base support, the edge being press-fitted on the tube.

The first and second body portions of the spacing element form one single element.

Spacing element has a U-shape.

Spacing element is cylindrical.

Support element is metallic.

Spacing element is metallic, obtained by forging, stamping or sintering.

Spacing element is made from synthetic material.

Support element comprises a first outer cylindrical surface of a first diameter adapted to slide in a bore and spacing element comprises a second outer cylindrical surface of a second diameter, first and second diameters being equal.

The mechanical system comprises a rolling bearing, a sliding bearing or a bushing positioned at the interface between the pin and the roller element.

Another object of the invention is an injection pump for a motor vehicle, comprising such a mechanical system actuated by a movable element.

Another object of the invention is a valve actuator for a motor vehicle, comprising such a mechanical system actuated by a movable element.

BRIEF DESCRIPTION OF THE DRAWINGS

The invention will now be explained in correspondence with the annexed figures, as an illustrative example, without restricting the object of the invention. In the annexed figures.

DETAILED DESCRIPTION OF SOME EMBODIMENTS

Figure 1:
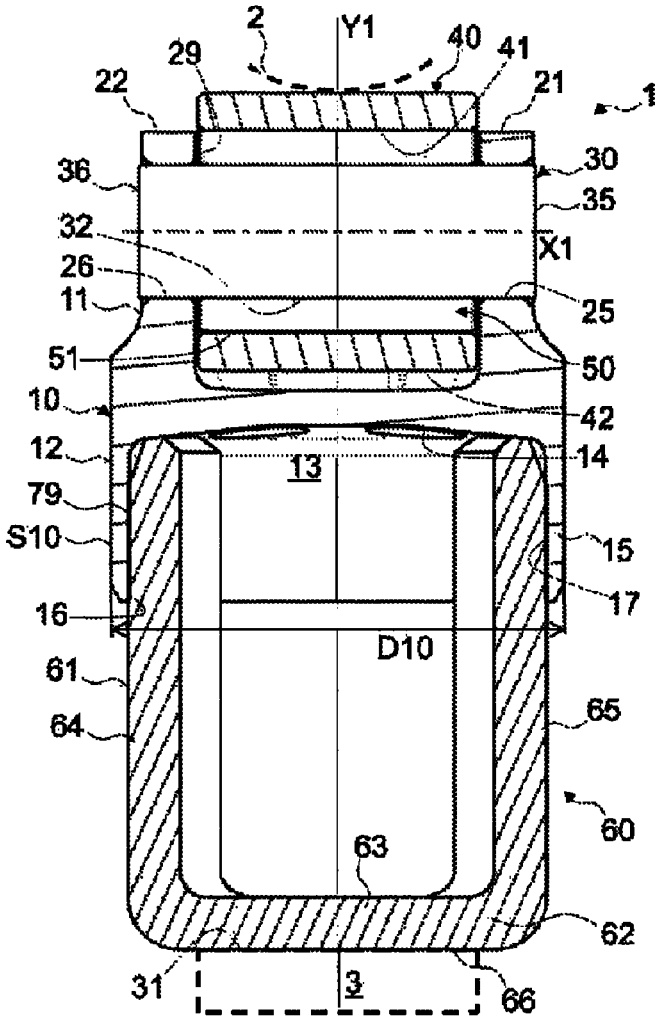
FIG. 1 is a sectional view of a mechanical system according to a first embodiment of the invention, of the cam follower type, comprising a tappet, a pin and a roller.

The mechanical system 1 represented on FIGS. 1 to 4 is of the cam follower type, adapted to equip an injection pump or a valve actuator for a motor vehicle, not shown.

System 1 comprises a tappet 10, a pin 30 and a roller 40. Pin 30 and roller 40 are centered on a transverse axis X1, while tappet 10 is centered on a longitudinal axis Y1. Axes X1 and Y1 are perpendicular. Roller 40 is adapted to roll on a cam 2, shown in dashed line on FIG. 1.

Tappet 10 comprises a first body part 11 on an upper end and a second body 12 on a lower end, both centered on axis Y1.

Tappet 10 has a cylindrical outer surface S10 of diameter D10, with a circular basis, centered on axis Y1 and extending along body part 12 and partly body part 11. Tappet 10 is movable back and forth along axis Y1, in a non-represented bore belonging to the injection pump, with surface S10 sliding in this bore. Tappet 10 is made of metal, by example steel. Material of the tappet 10 is chosen resistant to oil flow and temperature variations.

Tappet 10 forms a support element for pin 30 and roller 40. Specifically, first body part 11 of tappet 10 is adapted to receive pin 30, on which roller 40 is mounted. To this end, first body part 11 comprises two lateral flanges 21 and 22 extending parallel to axis Y1. The flanges 21 and 22 delimit an intermediate gap 29 between them. Each lateral flange 21 and 22 includes a cylindrical bore, respectively 25 and 26. Both bores 25 and 26 have the same diameter and extend through flanges 21 and 22 along axis X1.

Roller 40 has an outer cylindrical surface 41 and an internal cylindrical bore 42, both merging with transversal axis X1.

Pin 30 comprises a cylindrical outer surface 32 extending between two pin ends 35 and 36. When pin 30 is inserted in bores 25 and 26 of second body part 12 of tappet 10, surface 32 is adjusted with bore 42 of roller 40, such that roller 40 is movable in rotation relative to pin 30 around axis X1. Both pin 30 and roller 40 axes merge with axis X1.

A plurality of rolling elements 50, such as rollers or needles, is located at the interface between pin 30 and roller 40. Rolling elements 50 have each outer cylindrical surface 51 that is adjusted with bore 42 of roller 40 and with outer surface 32 of pin 30, such that roller 40 is movable in rotation relative to pin 30 around axis X1. As an alternative not shown, a bushing or any other appropriate type of sliding or rolling bearing can be used.

Roller 40 is adapted to roll on cam 2. More precisely surface 41 can roll on the outer surface of cam 2. When cam 2 and roller 40 are cooperating, a force is applied on surface 41 along axis Y1.

Tappet 10 further comprises second body part 12 delimiting a cavity 13 inside tappet 10. Such cavity 13 defines a cylindrical hollow shape with upper ceiling 14, annular walls 15 and lower opening 16, centered on longitudinal axis Y1. The annular walls 15 are cylindrical and have cylindrical outer surface S10 of diameter D10.

Figure 2:
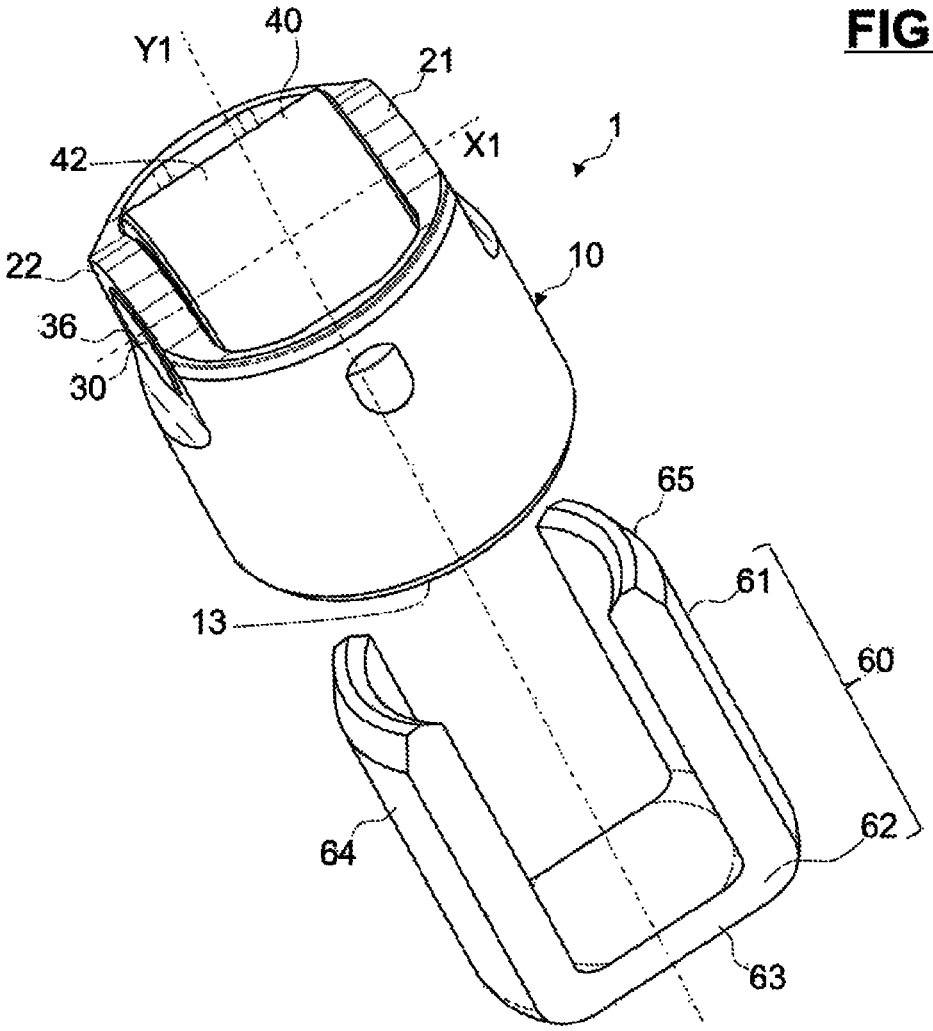
FIG. 2 is a perspective view of the mechanical system of FIG. 1.

According to a first embodiment of the invention illustrated in FIGS. 1 and 2, the mechanical system 1 further comprises a spacing element 60.

Spacing element 60 is formed as a single part and comprises a first body portion 61 and a second body portion 62, both portions being centered on longitudinal axis Y1.

Second body portion 62 of the spacing element 60 is a plate 63 defining a surface 66 perpendicular to longitudinal axis Y1 and adapted to come into contact and being supported by a movable element 3, for example a shaft or a plunger, shown in dashed line on FIG. 1. More precisely, the movable element 3 is provided with a surface 31 perpendicular to longitudinal axis Y1 on which the plate 63 of the second spacing element 60 bears. As an alternative not shown, the plate 63 of the spacing element 60 and the movable element 3 may be attached together.

The plate 63 of the spacing element 60 has a rectangular shape. As an alternative, the plate 63 is circular.

First body portion 61 of the spacing element 60 is at the opposite side of the movable element 3. The first body portion 61 comprises two lateral flanges 64, 65 that perpendicularly extend from two sides of the plate 63 in the opposite direction of the movable element 3. Lateral flanges 65, 66 are parallel to longitudinal axis Y1, are diametrically positioned and face each other. As an alternative not shown, first body portion 61 may comprise more than two flanges extending from the plate 63.

Flanges 65, 66 are inserted within the cavity 13 of the support element 10 and are attached together. Spacing element 60 and support element 10 are then attached together. Flanges 65, 66 are press-fitted against an inner lateral cylindrical surface 17 defined by walls 15 of the cavity 13. Alternatively, flanges 65, 66 are welded, glued or attached by any other appropriate means in cavity 13, by pins or retaining ring for example.

Spacing element 60 is made of metal, by example steel, and obtained by forging, stamping or sintering. Advantageously, spacing element 60 has a U-shape and is made from a blank metal sheet that is bended in two portions so as to form two flanges 65, 66 extending from a base plate 63.

Thanks to the invention, all the constitutive elements of the mechanical system 1 can be standardized except spacing element 60 so as to be used and installed in any type or any dimension of applications. In particular, the longitudinal length of flanges 65, 66 can be adjusted depending on the application geometry so as to adapt the longitudinal distance between mechanical system 1 and movable element 3.

Moreover, an additional element is added to the mechanical system 1 without increase of the system weight since the element is inserted in a cavity made in the tappet.

Figure 3:
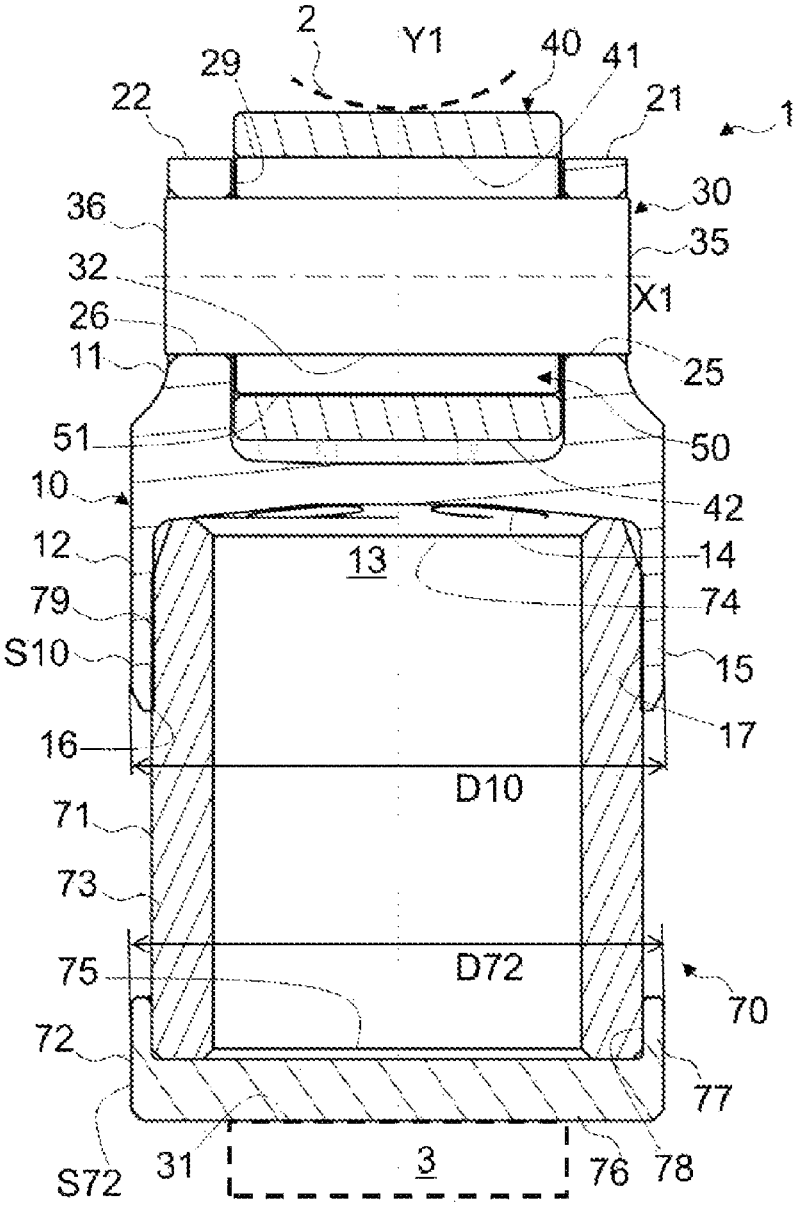
FIG. 3 is a sectional view of a mechanical system according to a second embodiment of the invention.
Figure 4:
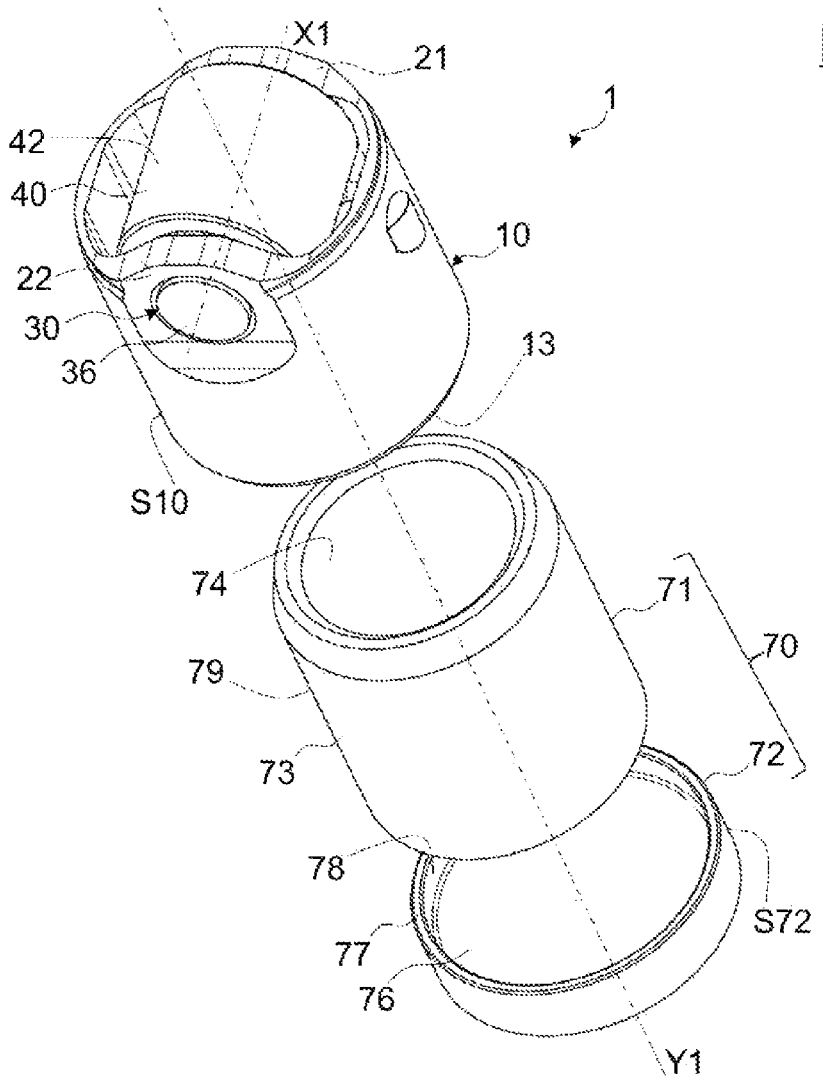
FIG. 4 is a perspective view of the mechanical system of FIG. 3.

The second embodiment of the invention illustrated in FIGS. 3 and 4, in which identical elements bear the same references, differs from the first embodiment of FIGS. 1 and 2 in that the mechanical system 1 comprises a spacing element 70 made in two distinct parts.

Spacing element 70 comprises a first body portion 71 and a second body portion 72 that are centered on longitudinal axis Y1.

First body portion 71 of spacing element 70 is a tube provided with a peripheral annular wall 73 and openings 74, 75 at each end so as to define a cylinder hollow shape. Alternatively, tube 71 is a massive cylinder.

Tube 71 defines an outer cylindrical lateral surface 79 press-fitted in the inner lateral cylindrical surface 17 defined by lateral walls 15 of the cavity 13 of the support element 10. Alternatively, tube 71 is welded, glued or attached by any other appropriate means in cavity 13, by pins or retaining ring for example.

Second body portion 72 of spacing element 70 is a base support comprising a plate 76 and an outer edge 77 axially extending from the plate 76 parallely to longitudinal axis Y1.

Plate 76 is adapted to come into contact and being supported by the movable element 3. More precisely, the movable element 3 is provided with a surface 31 perpendicular to longitudinal axis Y1 on which the plate 76 of the second spacing element 70 bears. As an alternative not shown, the plate 76 of the spacing element 70 and the movable element 3 may be attached together.

The outer periphery of the plate 76 comprises edge 77. The edge 77 defines an inner lateral cylindrical surface 78 of diameter slightly smaller than the diameter of the outer cylindrical lateral surface 79 of the tube 71. Tube 71 and second body portion 72 are attached together by press-fitting the tube 71 within edge 77. Alternatively, tube 71 and second body portion 72 are welded, glued or attached together by any other appropriate means, by pins or retaining ring for example.

Thanks to the invention, all the constitutive elements of the mechanical system 1 can be standardized except spacing element 70 so as to be used and installed in any type or any dimension of applications. In particular, the longitudinal length of tube 71 can be adjusted depending on the application geometry so as to adapt the longitudinal distance between mechanical system 1 and movable element 3. The second body portion 72 of the spacing element 70 can also be a standardized part, only the tube 71 being adaptable.

Advantageously, second body portion 72 of spacing element 70 defines an outer cylindrical surface S72 of diameter D72 that is equal to the diameter D10 of the outer cylindrical surface S10 of the tappet 10.

When tappet 10 moves back and forth along axis Y1, in a non-represented bore belonging to the injection pump, surface S10 slides in this bore. Surface S72 of spacing element 70 forms a second sliding surface for the mechanical system 1 within the bore and then ensure an improved guiding function.

According to another embodiment (not shown) of the invention, the tube 71 and the second body portion 72 form a spacing element 70 in one single part, the tube 71 being opened on one end 74 and closed on the other end 75.

In addition, technical features of the different embodiments can be, in whole or part, combined with each other. Thus, the mechanical system 1 can be adapted to the specific requirements of the application.

What is claimed is:

1. A mechanical system, forming one of a cam follower or a rocker arm, the mechanical system comprising:

a support element comprising a first body part and a second body part centered on a longitudinal axis, the second body part defining a cylindrical hollow shape delimiting a cavity therein, the second body part forming a longitudinal end of the support element;

a pin extending between two opposite ends along a first axis and supported by the first body part of the support element;

a roller mounted on the pin, movable in rotation relative to the pin around the first axis and adapted to roll on a cam; and a spacing element comprising a first body portion connected to the second body part of the support element and a second body portion adapted to be supported by a movable support such that the spacing element is configured to locate the movable support a predetermined distance from the pin, the first body portion being partially located within the cavity of the second body part of the support element and extending past the longitudinal end of the support element in a direction away from the roller, the second body portion of the spacing element being spaced from the support element with respect to the longitudinal axis such that no portion of the movable support is located within the support element.

2. The mechanical system according to claim 1 wherein the first body portion of the spacing element is inserted and connected to the cavity.

3. The mechanical system according to claim 2, wherein the spacing element is press-fitted within the cavity of the support element.

4. The mechanical system according to claim 1, the first body portion of the spacing element further comprises at least two lateral flanges that perpendicularly extend from the second body portion of the spacing element.

5. The mechanical system according to claim 4, wherein the spacing element has a U-shape.

6. The mechanical system according to claim 1 wherein the first body portion and the second body portion of the spacing element are two distinct elements assembled and attached together.

7. The mechanical system according to claim 1, wherein the spacing element forms one single element.

8. A valve actuator for a motor vehicle, including the mechanical system of claim 1.

9. An injection pump for a motor vehicle, comprising the mechanical system of claim 1.

10. A mechanical system, forming one of a cam follower or a rocker arm, the mechanical system comprising:

a support element comprising a first body part and a second body part;

a pin extending between two opposite ends along a first axis and supported by the first body part of the support element;

a roller mounted on the pin, movable in rotation relative to the pin around the first axis and adapted to roll on a cam; and a spacing element comprising a first body portion connected to the second body part of the support element and a second body portion adapted to be supported by a movable support, the first body portion of the spacing element further comprises a tube provided with a peripheral annular wall and openings at each ends so as to define a cylinder hollow shape.

11. The mechanical system according to claim 10, the second body portion further comprising a base support at an end of the first body portion of the spacing element at the opposite side of the support element, wherein the base support defines a surface adapted to be supported by the movable element.

12. The mechanical system according to claim 11, the second body portion further comprises an edge axially extending from the base support.

13. The mechanical system according to claim 12, wherein an outer cylindrical surface of the tube is slightly greater than an inner cylindrical outer surface of the edge of the base support, the edge being press-fitted on the tube.

14. A mechanical system, forming one of a cam follower or a rocker arm, the mechanical system comprising:

a support element comprising a first body part and a second body part;

a pin extending between two opposite ends along a first axis and supported by the first body part of the support element;

a roller mounted on the pin, movable in rotation relative to the pin around the first axis and adapted to roll on a cam; and a spacing element comprising a first body portion connected to the second body part of the support element and a second body portion adapted to be supported by a movable support, the support element further comprises a first outer cylindrical surface of a first diameter adapted to slide in a bore; and the spacing element further comprises a second outer cylindrical surface of a second diameter, wherein the first diameter and the second diameter are equal to one another.

* * * * *